United States Patent [19]

Johnston et al.

[11] Patent Number: 4,777,976

[45] Date of Patent: Oct. 18, 1988

[54] PORTABLE HOSE CART AND METHOD OF USE

[75] Inventors: Damon A. Johnston, Aurora; George L. Garcia, Naperville, both of Ill.

[73] Assignee: Suncast Corporation, Batavia, Ill.

[21] Appl. No.: 65,968

[22] Filed: Jun. 24, 1987

[51] Int. Cl.[4] ..... B65H 75/34

[52] U.S. Cl. ..... 137/355.27; 242/86.2; 242/86.5 R; 15/256.6

[58] Field of Search ..... 137/242, 355.12, 355.16, 137/355.26, 355.27, 580; 15/256.6; 242/26, 86.5 R, 86.1, 86.2

[56] References Cited

U.S. PATENT DOCUMENTS

| | | | |
|---|---|---|---|
| 2,155,769 | 4/1939 | Porter | 242/86.5 R |
| 2,512,756 | 6/1950 | Wasserman | 242/86.2 |
| 2,755,035 | 7/1956 | Moulder | 242/86.2 |
| 3,051,189 | 8/1962 | Pro | 137/242 |
| 4,512,361 | 4/1985 | Tisbo | 242/86.5 R |
| 4,586,676 | 5/1986 | Johnston | 242/86 |

FOREIGN PATENT DOCUMENTS

| | | | |
|---|---|---|---|
| 1361417 | 7/1974 | United Kingdom | 15/256.6 |

*Primary Examiner*—A. Michael Chambers

*Attorney, Agent, or Firm*—Fitch, Even, Tabin & Flannery

[57] ABSTRACT

A portable garden hose cart for windably holding a hose and for transporting the hose between a storage location and the use location. The cart includes a frame having a pair of vertical sides each of which has a bearing. A reel is positioned between the frame sides with the reel having a pair of sides and a hose support surface extending therebetween. Each reel side has a generally horizontally extending hub rotatably received in the corresponding bearing of its associated frame side. The cart has an outlet tube carried by a reel for rotation therewith and an inlet tube mounted in one of the hubs so that the inlet tube is held from rotation with the reel. The inlet tube and the outlet tube are in fluid communication. A crank is attached to the other of the hubs to rotate the reel. A hose guide defines a window for passage of the hose with the frame supporting the hose guide spaced from the reel. The hose guide permits free passage of the hose through the window and the hose guide is freely movable along a horizontal path so that the hose can be wound on the reel in layers with adjacent turns being contiguous and without the operator touching the hose, by the operator simultaneously operating the crank and moving the hose guide. A method of operating the hose cart is also disclosed.

11 Claims, 8 Drawing Sheets

PORTABLE HOSE CART AND METHOD OF USE

The subject invention is directed to hose storage apparatus and, more particularly, to a portable hose cart including a horizontally movable hose guide.

BACKGROUND OF THE INVENTION

One of the necessities of home ownership is a garden hose for watering the lawn, washing cars, etc. Various products are available for ease of handling and storage of a garden hose while presenting a generally neat appearance of the hose. For example, commonly-assigned U.S. Pat. No. 4,586,676 is directed to a wall mounted hose reel having a fixed hose guide with rollers to facilitate winding of the garden hose on the reel.

Portable hose carts are also available which not only provide convenient winding and pay out of the hose, but additionally permit the hose to be easily moved between a use location and a storage location. For further information concerning the structure and operation of such a portable hose cart, reference may be made to commonly-assigned U.S. Pat. No. 4,512,361, the teachings of which are incorporated herein by reference.

In order to obtain a very aesthetic appearance using known garden hose winding and storage apparatus, it is necessary for the user to employ his or her hand to guide the hose as it is being taken up so that adjacent turns of each layer of the winding lay closely adjacent and so that an inner layer of turns is completed across the support surface of the reel before the next layer is started. However, this causes the hand of the user to become soiled with mud, leaves or other material picked up by the hose as it is pulled along the ground.

A proposed hose reel assembly to be installed at an airport for taking up a hose used to provide aviation fuel includes a vertically disposed reel. The reel is motor driven and the hose is coiled in a single layer starting at the bottom of the reel so that the flammable liquid automatically drains. A rotary lead screw, vertically disposed and spaced from the reel, is driven by the motor. The lead screw moves a traveling guide, between the rollers of which the fuel hose passes, for locating the turns of the coils. For further information concerning the operation of such hose reel assembly, reference may be made to U.S. Pat. No. 2,595,655. A pivotable hose guide is disclosed in U.S. Pat. No. 2,422,353.

SUMMARY OF THE INVENTION

Among the several aspects and features of the present invention may be noted the provision of an improved portable garden hose cart. The cart of the present invention permits the hose to be wound into a coil of multiple layers with adjacent turns of each layer touching each other and without the operator touching the hose. Pay out of the hose is fast and convenient, and does not require the operator to touch the cart. The cart is very stable during winding of the garden hose, and there is no tipping of the cart during pay out of the hose. The cart also provides covered storage of nozzles and other hose accessories, is easy to assemble and has a large hose storage capacity. Furthermore, the cart is reliable in use, has long service life and is easy and economical to manufacture. Other aspects and features of the present invention will be, in part, apparent and, in part, pointed out hereinafter in the following specification and accompanying drawings.

Briefly, the garden hose cart of the present invention includes a frame having a pair of generally vertical sides each of which has a bearing with a bearing surface. A reel is disposed between the frame sides and includes a pair of reel sides with a support surface extending therebetween. Each reel side has a generally horizontally extending hub received in the corresponding bearing surface of its associated frame side. An outlet tube is carried by the reel for rotation therewith and has an end adapted for attachment to one end of the garden hose. An inlet tube is mounted in one of the hubs so that the inlet tube does not rotate with the reel, with the inlet tube and outlet tube being in fluid communication. The cart further includes means for rotating the reel to take up the hose and a hose guide defining a window for passage of the hose. The frame supports the hose guide spaced from the reel with the hose guide permitting substantially free passage of the hose through the window. The hose guide is freely movable along a horizontal path.

As a method of using the cart, the present invention includes the following steps:

(a) the reel is cranked with one hand to take up the hose;

(b) the guide is moved from adjacent its full left position toward its full right position in concert with the cranking of the reel to form an interior hose layer with adjacent turns in the layer touching;

(c) the guide is moved back towards its full left position in concert with further cranking to form a second layer of closely adjacent turns; and (d) the reciprocation of the hose guide while cranking is continued to place other layers of the garden hose on the reel until the hose is fully coiled, all of these steps being performed without the operator touching the hose.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
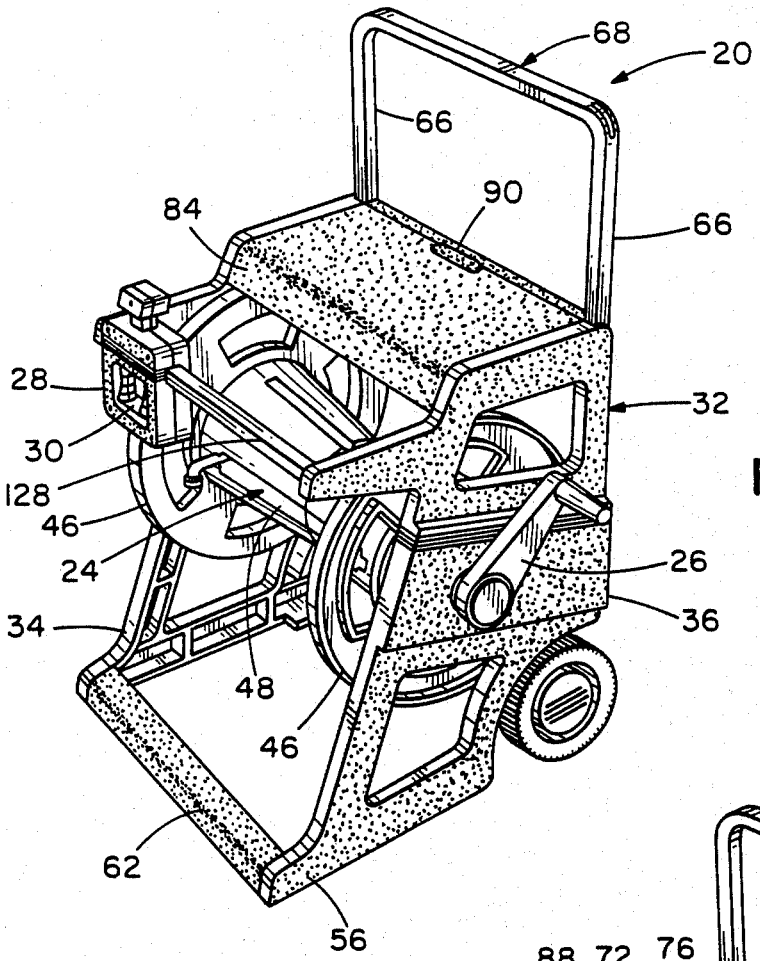
FIG. 1 is a perspective view of a portable hose cart embodying various aspects of the present invention.
Figure 2:
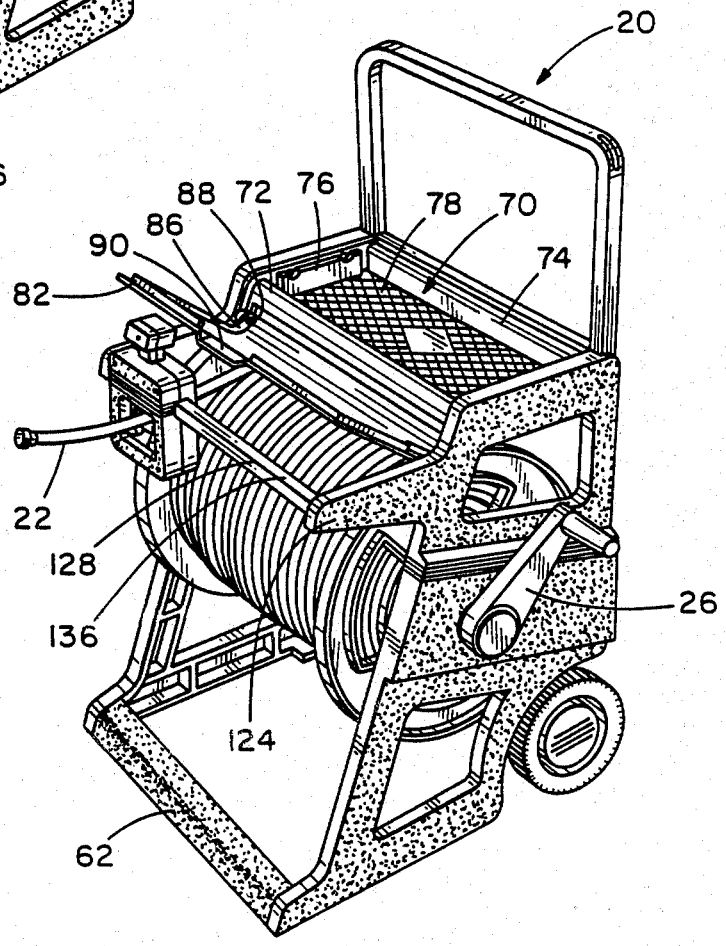
FIG. 2, similar to FIG. 1, shows the cart with the lid to a storage box, at the top of the cart, in its open position and with the garden hose fully wound on the reel.

Referring now to the drawings, a portable hose cart embodying various features of the present invention is generally indicated in FIGS. 1–9 by reference numeral 20. The cart is useful for windably holding a garden hose 22 and for transporting the hose between a storage location and a use location. Cart 20 includes a reel 24 operated by a crank 26 for winding the hose. A horizontally movable hose guide 28 has a window 30 through which the hose passes. By cranking the reel in concert with reciprocating the hose guide, the user is able to neatly wind the hose with adjacent turns in each layer touching, as shown in FIG. 2. An important advantage of the cart is that the winding can be accomplished without the operator touching the cart, thus the user's hands do not become soiled with dirt or debris carried by the hose. The cart 20 is preferably primarily made of molded thermoplastic components resulting in long service life of the cart in outdoor use and in frequent contact with water.

Figure 10:
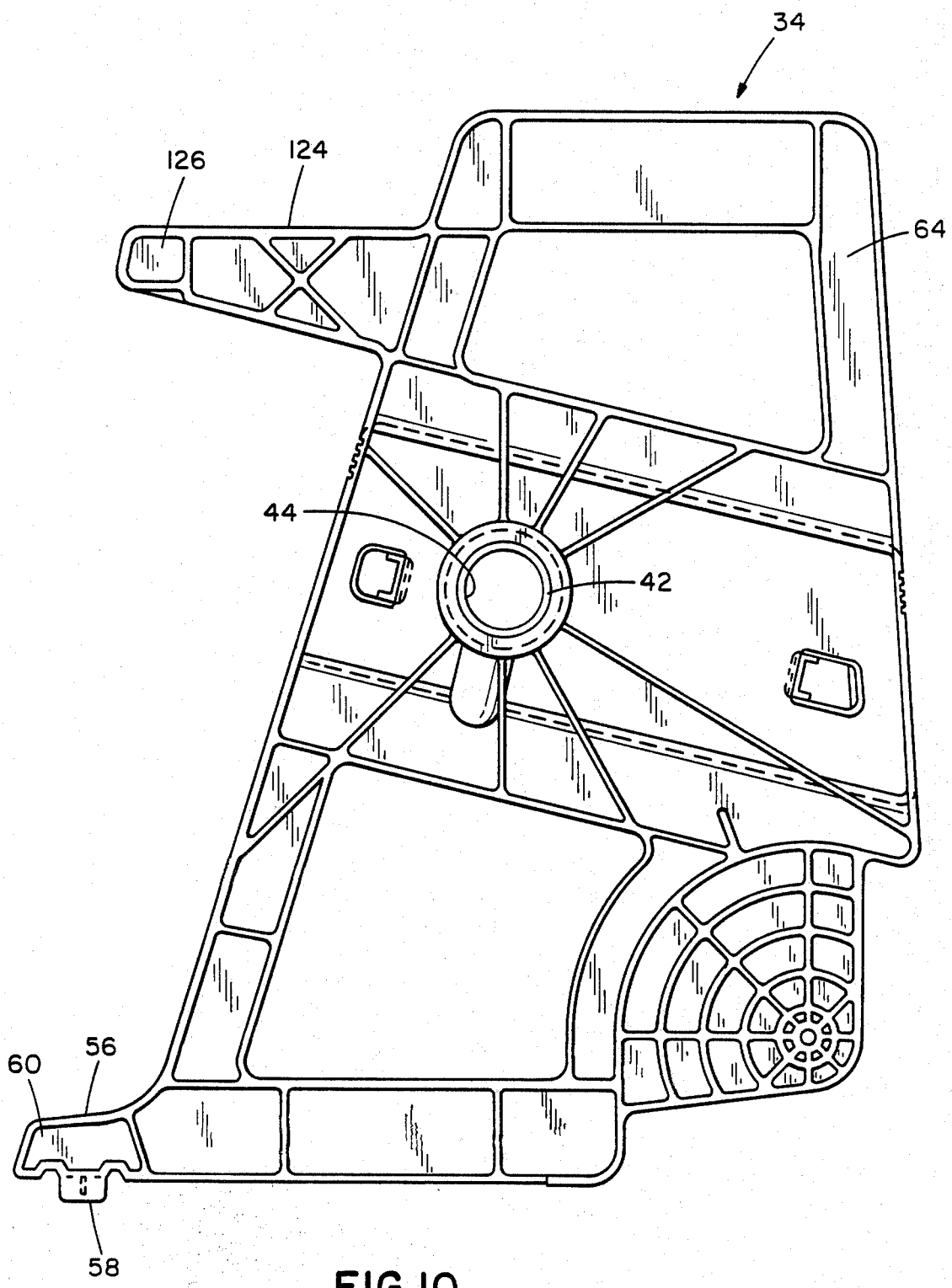
FIG. 10 illustrates the inside surface of one of the sides forming the frame of the cart.
Figure 11:
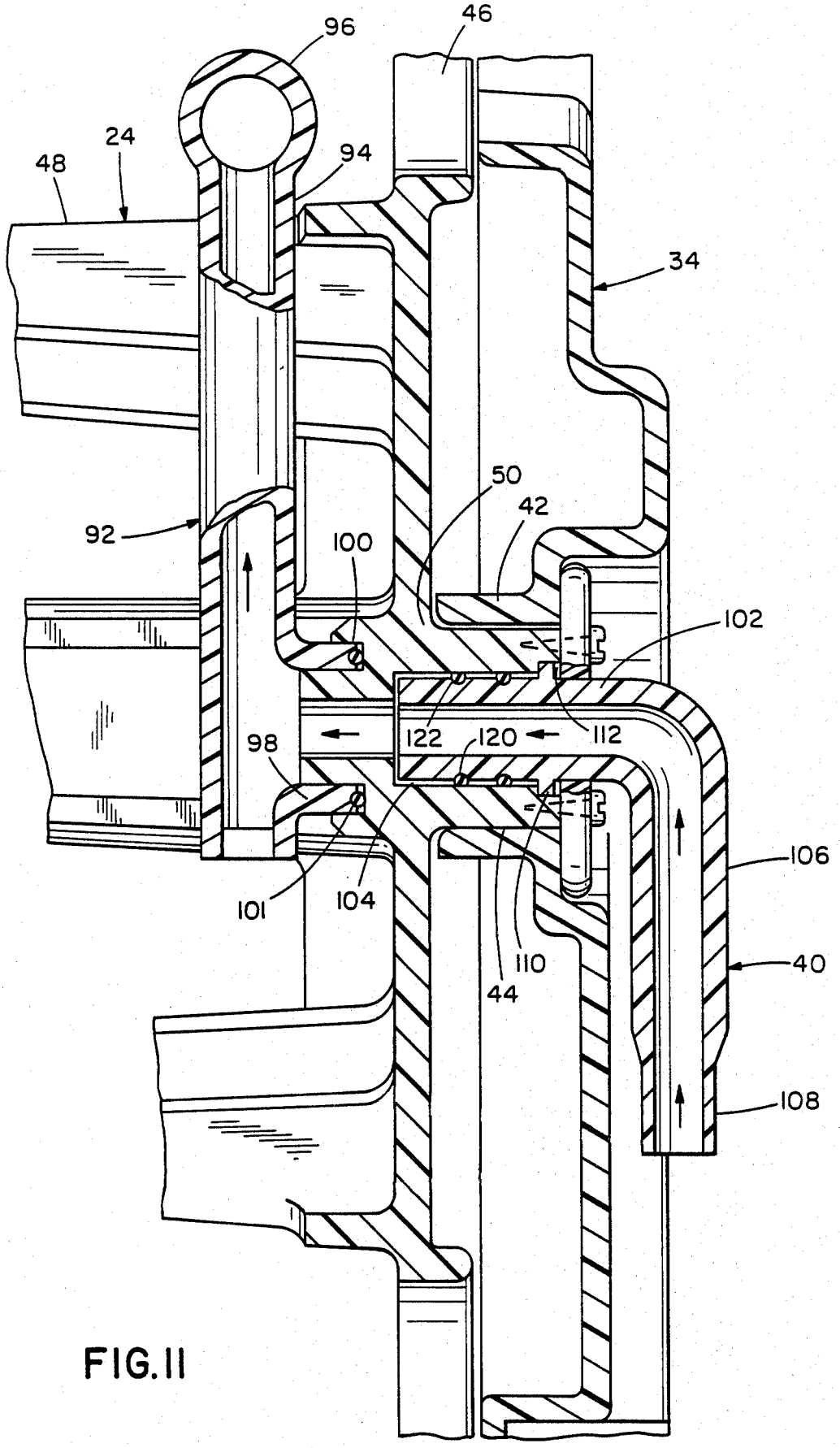
FIG. 11 is an enlarged cross sectional view of a portion of the reel and a hose connector secured to the hub.

More specifically, the cart 20 includes a frame 32 including a pair of generally vertical sides 34, 36 which are substantially mirror images of each other except the left frame side 34, the interior of which is shown in FIG. 10, has on its outside surface a pair of clips 38 for holding a short hose to be used to connect an inlet tube 40, best shown in FIG. 11, to a faucet. Each frame side includes an annular bearing 42 having a bearing surface 44. The cart further includes the reel 24 which is preferably formed of two identical molded thermoplastic halves, as fully described in commonly-assigned U.S. Pat. No, 4,512,361. The reel 24 includes reel flanges or sides 46 with a reel support surface 48, upon which garden hose 22 is wound, extending intermediate the sides. The reel further includes a hub 50 extending outwardly from each reel side 46 received by the bearing 42 of the associated frame side 34, 36 to rotatably hold the reel with respect to the frame.

Figure 9:
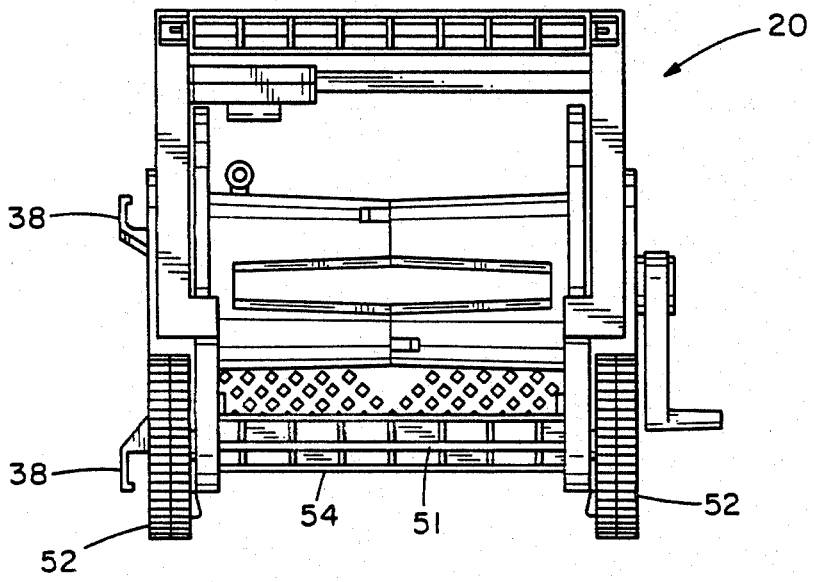
FIG. 9 is a bottom view of the cart of FIG. 1.

Each frame side 34, 36 at its lower rear has an aperture through which passes a metallic axle 51, best shown in FIG. 9, the ends of which rotatably carry wheels 52 which are retained on the axle by means of, for example, Tinnerman nuts, as well as known by those of skill in the art. A channel-shaped bar 54 is attached to the frame side 34, 36 overlying the axle 50 to serve a dual purpose as a stiffener for the frame and a shield for the axle. Each frame side 34, 36 has at its front a forwardly extending foot 56 with a dependent toe 58, see FIG. 10. Each foot defines a cavity 60 for receiving an end of a forward reinforcing bar 62 which is preferably affixed to the frame sides by screws. The feet 56 serve to preclude forwardly tipping of the cart while the toes 58 tend to serve as anchors.

On the interior of each frame side at the upper rear is a vertically-extending cavity 64 for receiving one of the legs 66 of a U-shaped handle 68, preferably formed of aluminum, which legs are attached to their associated frame sides by screws. By placing his or her foot behind the rear bar 54 and pulling the handle rearwardly, the cart can be tilted (lifting the toes 58 off the ground) so that the entire weight of the cart and hose is on the wheels, enabling the cart to be conveniently moved between a use location and a storage location.

Also interconnecting the top portions of the frame sides is a storage box 70 including a front wall 72, a back wall 74, side walls 76 attached by screws to the frame sides, and a floor 78 having an array of openings to permit draining of, for example, nozzles stored in the box. The box 70 also includes a pivotable lid 82 having an inclined forward extension 84 having lateral ribs 86 including apertures receiving inwardly directed pins 88 carried by extensions of side walls 76 disposed forward of front wall 72. A raised lip 90 is provided at the rear of the lid for ease of opening.

Referring now to FIG. 11, the hub 50 through which the water passes has attached on its inside an outlet tube 92 including a radial tube 94 extending beyond the reel support surface 48 and terminating in a male connector 96 with a thread on its outer surface for connection to the female fitting at the end of the garden hose. The outlet tube 92 also includes a lateral extension 98 received in an annular groove 100 in the hub. An O-ring 101 is compressed between the extension 98 and the hub to effect a seal. The outlet tube 92 is attached to the hub by means of screws passing through mounting ears extending radially from the extension 98, as shown in U.S. Pat. No. 4,512,361, the teachings of which are incorporated herein by reference. Thus, the outlet tube 92 rotates with the reel 24.

Figure 6:
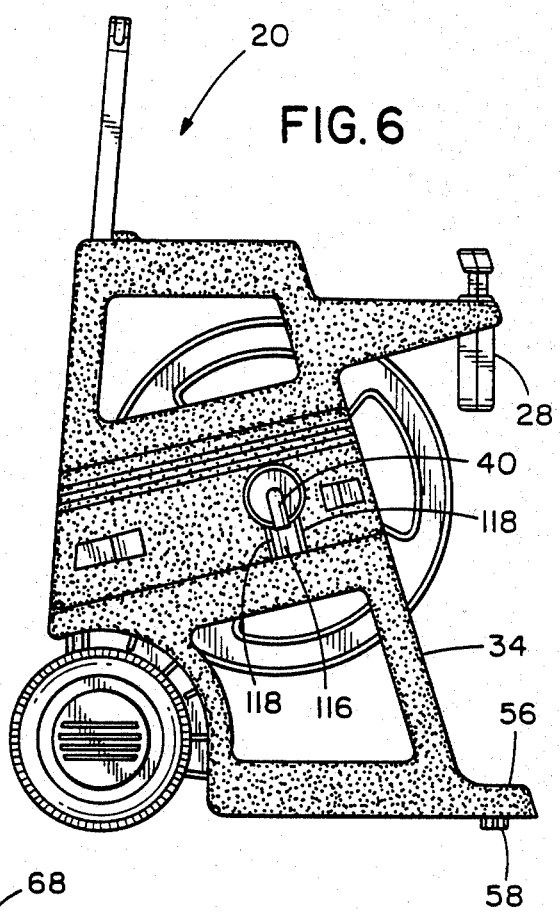
FIG. 6 is a left side elevational view of the cart of FIG. 1.
Figure 7:
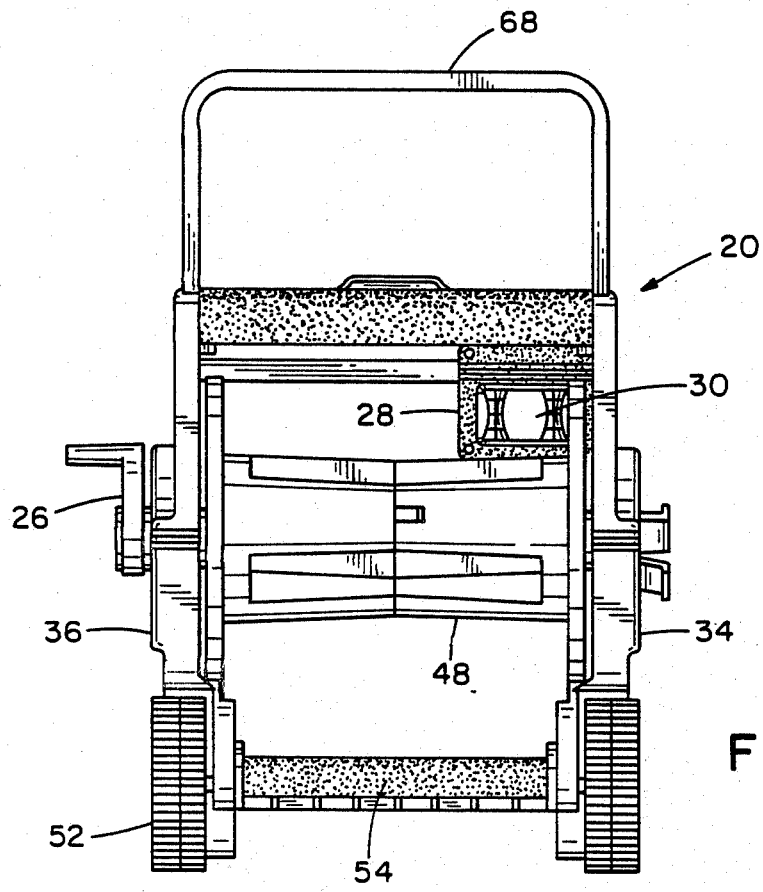
FIG. 7 is a rear elevational view of the cart of FIG. 1.
Figure 8:
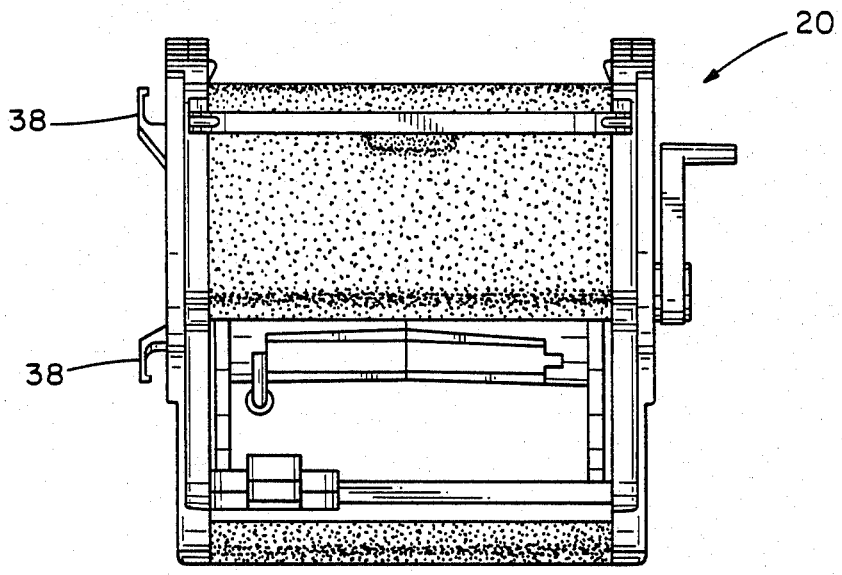
FIG. 8 is a plan view of the cart of FIG. 1.

The inlet tube 40 is L-shaped and includes a horizontal inlet portion 102 extending into an opening 104 through the hub, and a vertical portion 106 terminating in a reduced thickness end 108 to which the end of a short hose, for connection of the cart to an outdoor faucet, may be connected using a common hose clamp. The horizontal inlet portion has a flange 110 received in a flange recess 112 at the end of the hub adjoining the hub opening 104. A lock plate 114 having an aperture through which the inlet tube passes, is attached to the hub 50 to hold the horizontal inlet portion in the opening 104 by blocking the flange 110. As best shown in FIG. 6, the exterior of frame side 34 includes a channel 116 for seating the connected end of the short hose, including a pair of flanking arms 118 which engage the hose and prevent rotation of the inlet tube 40 with the reel 24.

Referring to FIG. 11, the outside surface of the horizontal inlet portion 102 is provided with spaced annular grooves 120 seating sealing means in the form of O-rings 122 which are compressed against the inside surface of the hub defining opening 104. It will be appreciated that as the O-rings 122 are inside the hub and in vertical alignment with the bearing surface 44 of the frame bearing 42, the O-rings 122 are not loaded by the weight of the reel, the garden hose or any water in the hose. As they are not subjected to such compressive forces, they provide effective sealing and have a long service life. An additional advantage of the use of the O-rings in vertical alignment with the bearing is that the bearing and hub can have a relatively loose fit to promote ease of rotation of the reel. The crank 26 has a base, similar to lock plate 114, connected to the other hub 50 by screws.

Figure 12:
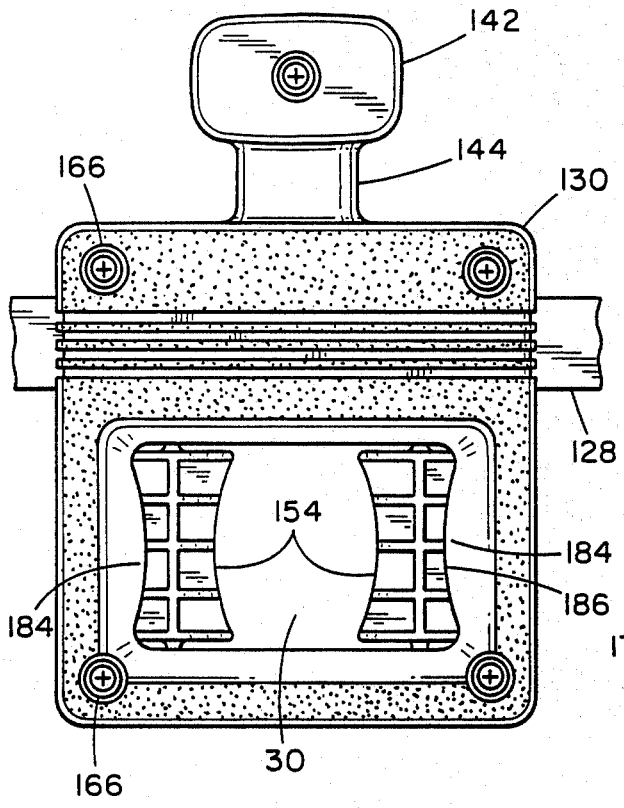
FIG. 12 is a rear elevational view of the hose guide.
Figure 15:
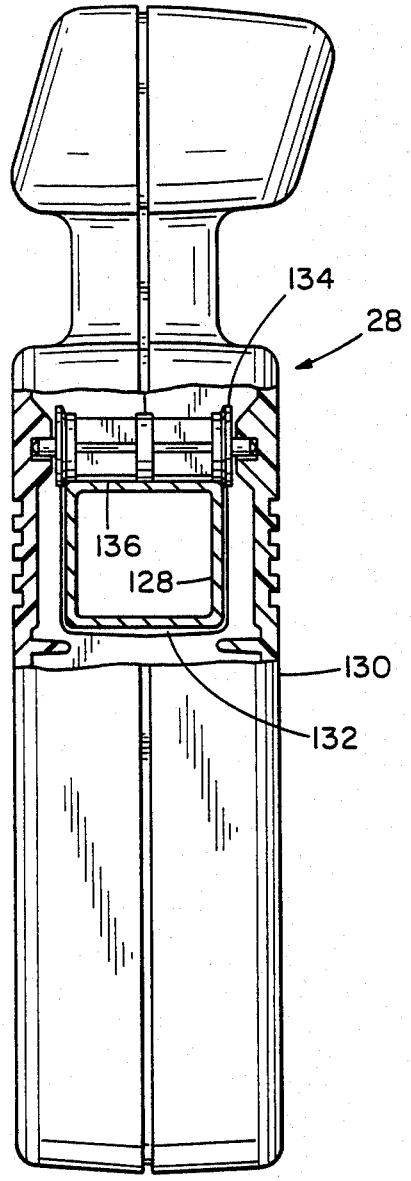
FIG. 15 is a side elevation view of the hose guide.

The portable hose cart 20 further includes the hose guide 28 which is supported by the frame 32, spaced from the reel 24 and disposed above the level of the hubs 50. More specifically, referring to FIG. 10, each frame side includes a forwardly extending arm 124 aligned with the arm of the other frame side. At the distal end of each arm 124 is a cavity 126 receiving one end of a rail 128, preferably of square cross section and fabricated of aluminum, attached to the arms by means of screws. The hose guide 28, best shown in FIGS. 12 and 15, comprises a housing 130 defining a channel 132 extending above and transversely with respect to the window 30. The rail 128 extends through the channel 132 and the housing carries roller means in the form of interior wheels 134, best shown in FIG. 17, extending partially into the channel for engaging the top surface 136 of the rail so that the hose guide is substantially freely horizontally movable on the rail.

Figure 13:
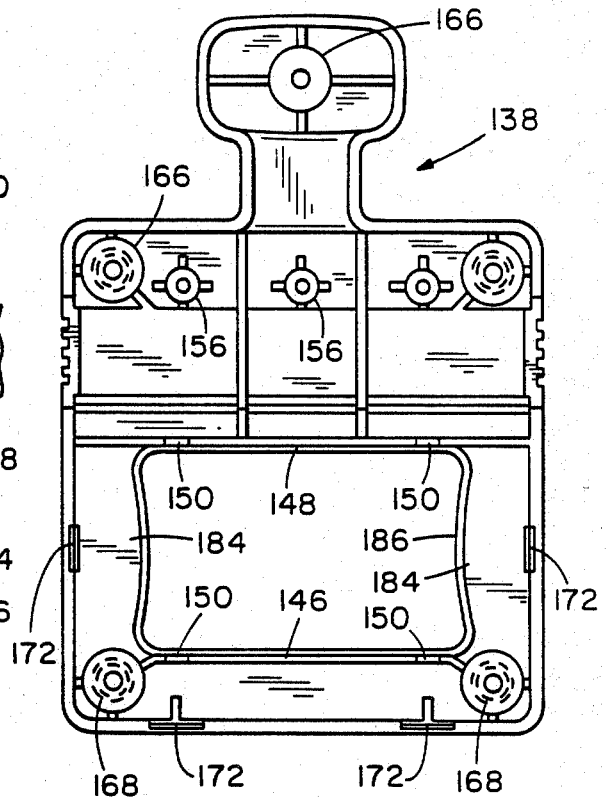
FIG. 13 depicts the interior of the rear housing half of the hose guide.
Figure 14:
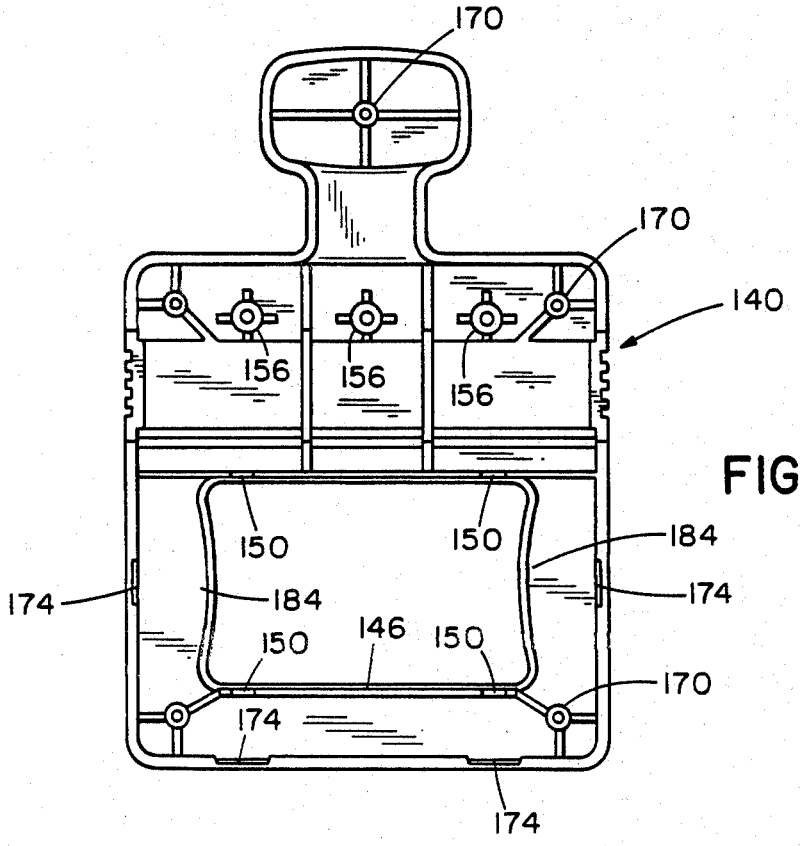
FIG. 14, similar to FIG. 13, shows the interior of the front housing half of the hose guide.

The hose guide housing 130 is formed by a pair of molded thermoplastic housing halves fastened together. The interior of the rear housing half 138 is depicted in FIG. 13, while FIG. 14 illustrates the interior of the front housing half 140. The housing has at its top handle means in the form of a knob 142, for grasping by the user, connected to the remainder of the hose guide by a stem 144. Each housing half includes a lower horizontal wall 146 and an intermediate horizontal wall 148 framing the window 30. Each wall 146, 148 has aligned left and right recesses 150 which rotatably receive the axle pins 152 of vertically disposed rollers 154 best shown in FIG. 16, disposed at the sides of the window. These vertical rollers 154 facilitate passage of the garden hose through the guide, and are particularly useful when the hose passes through the guide at a sharp angle.

Figure 17:
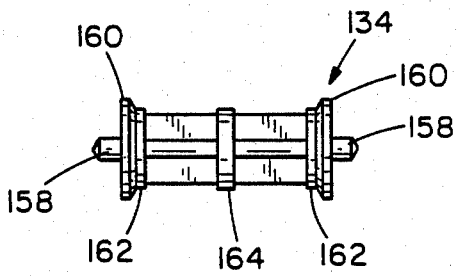
FIG. 17 is a front elevational view of one of the interior wheels carried by the guide.

Each housing half 138, 140 includes a trio of cylindrical bearings 156 for receiving the axle pins 158 of wheels 134. The bearings are integrally formed with each housing half and are disposed above the channel 132 so that the wheels extend partially into the channel. Although three wheels can be accommodated, at least the two outer pairs of bearings are used to rotatably hold the wheels 134 so that there is no substantial frictional engagement of the rail 128 by the housing 130. In this regard, as shown in FIG. 17, each wheel has spaced flanges 160 flanking the rail, with a rim 162 adjoining each flange and a central annular ridge 164. As contact with the rail top surface is localized at the rims and the ridge, friction is reduced and the guide 22 is substantially freely horizontally movable on the rail.

The rear housing half 138 has a quintet of deeply recessed pockets 166 each terminating in an end wall 168 for abutting the head of a screw the threaded shank of which is threadably received by an aligned apertured post 170 integral with the front housing half 140, thereby attaching the housing halves. The rear half 138 carries several alignment fingers 172, disposed about the window 30, received by aligned recesses 174 in the front half to further stabilize and guide assembly of the halves.

Figure 16:
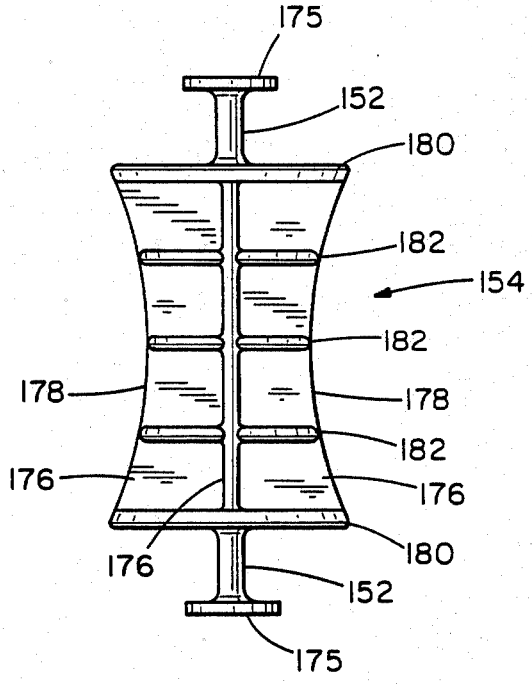
FIG. 16 is a front elevational view of one of the vertical rollers held by the guide.

Referring to FIG. 16, each vertical roller axle pin 152 terminates in an enlarged head 175 to prevent escape of the roller from the housing. Each roller 154 comprises four radial ribs 176, each terminating in a concave working surface 178 for engaging the hose. The ribs extend between annular end walls 180, and spaced intermediate reinforcing walls 182 are provided in sizes determined by the curvature of the working surfaces. The concavity of the working surfaces 178 tend to maintain the garden hose in contact with the rollers 154.

Most components of the cart 20 are preferably manufactured of molded engineering thermoplastics. The reel, frame sides and hose guide housing are preferably polyethylene. The rollers 154 are preferably made of polycarbonate which has high impact strength while the wheels 134 are preferably made of acetal which in addition to having high impact strength, is self lubricating.

The housing further includes scrapper means extending closely adjacent each vertical roller 154 for removing foreign matter transferred from the hose to the rollers. The scrapper means includes a pair of inwardly directed and converging scrapper blades 184 associated with each roller 154. Each blade 184 preferably terminates in a convex scrapping edge 186. The rear blades 184 are integral with rear half 138 while the front blades are integral with front housing half 140.

Figure 3:
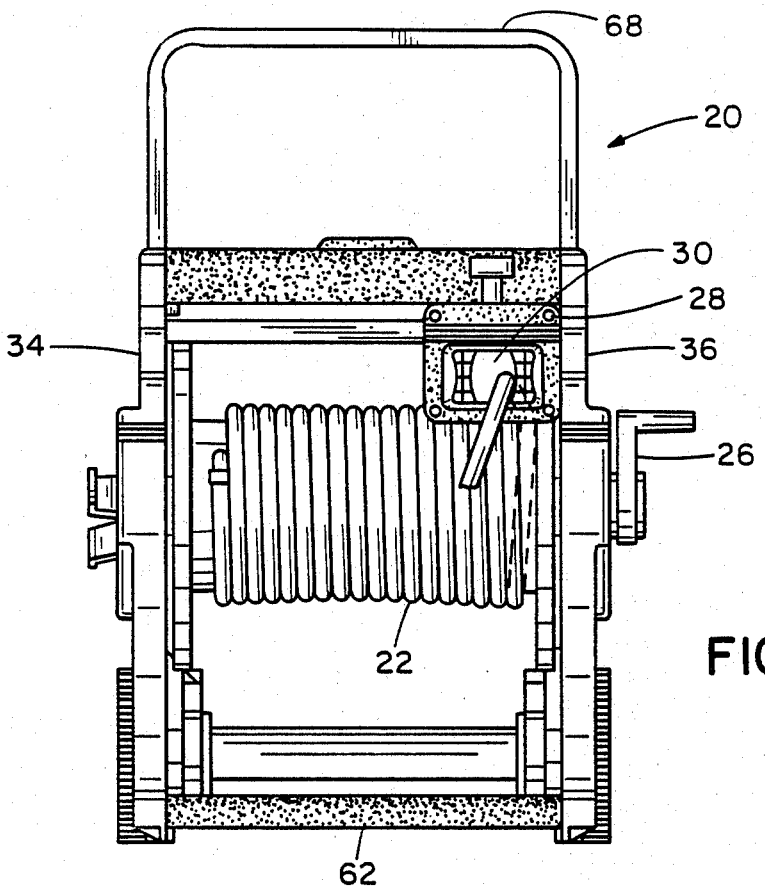
FIG. 3 is a front elevational view of the cart of FIG. 1 depicting a horizontal movable hose guide in its full right position with an inner layer of the garden hose wound on the reel.
Figure 4:
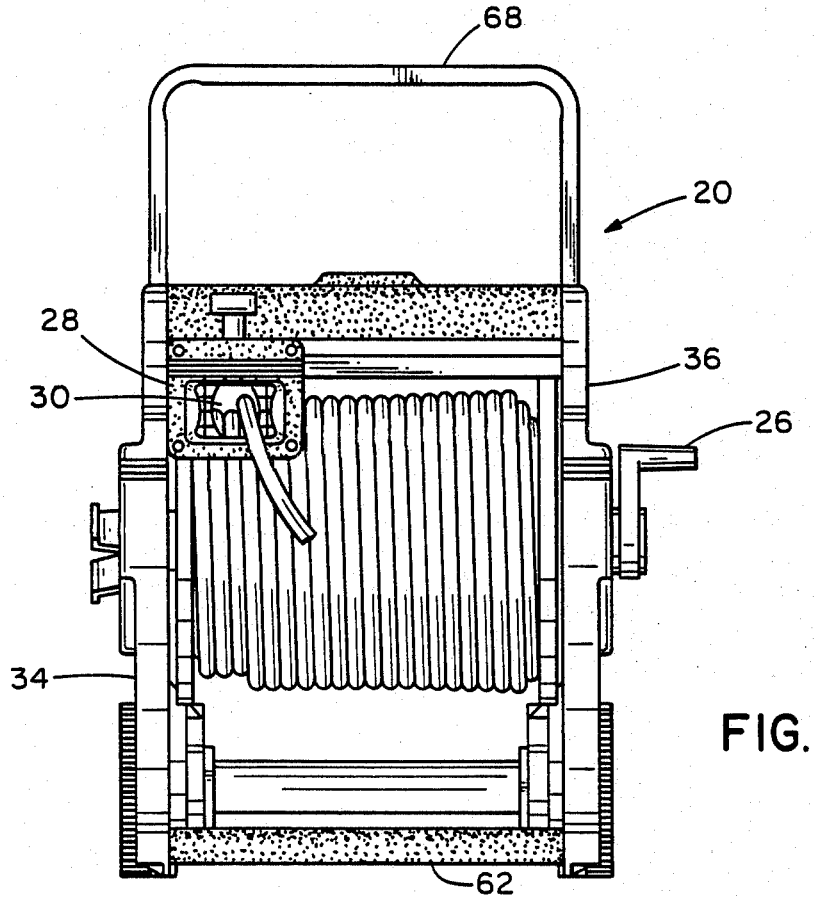
FIG. 4, similar to FIG. 3, shows a second layer of a hose wound on the reel of the cart, with the hose guide in its full left position.
Figure 5:
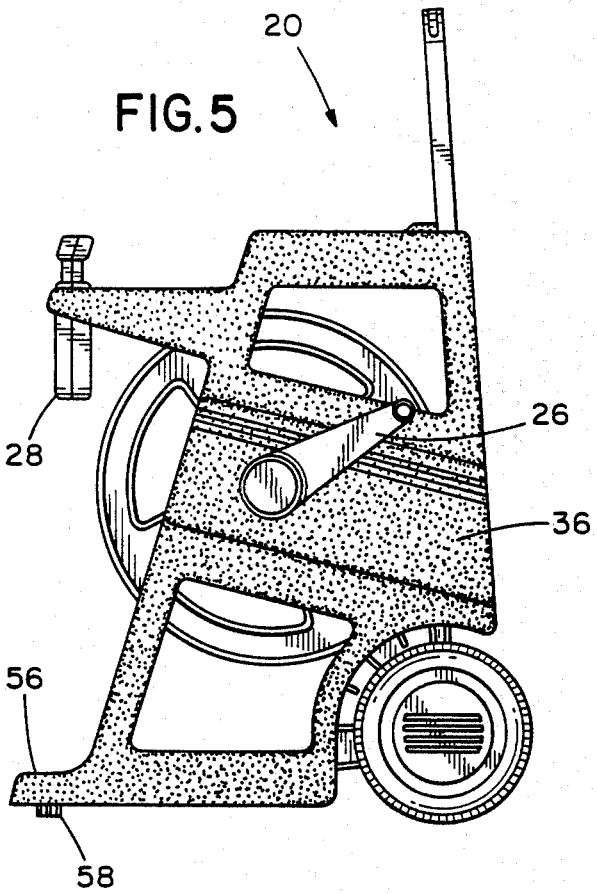
FIG. 5 is a right side elevational view of the cart of FIG. 1.

Operation of the portable hose cart 20 of the present invention is as follows: With the hose guide 28 in its full left position shown in FIG. 1, the end of the hose carrying the female connector may be inserted through the window 30 of the guide and attached to the threaded connector 96 of the radial tube 94. By placing one foot on the forward reinforcing bar 62 while operating the crank 26 with one hand, the operator can use the hose guide 28 to place adjacent turns of the wound hose in the inner layer of the coils so that the adjacent turns touch. When the operator has completed the inner layer, at which time the hose guide will be in its full right position as shown in FIG. 3, the operator can place the second layer with adjacent turns contiguous by moving the hose guide 28 toward its left position while using the crank to rotate the reel. This operation is continued until the entire hose is taken up. The result will be an extremely neatly wound hose, and the operator has no need to touch the hose after connection of the female end of the garden hose 22 to the radial tube connector 96. After the cart 20 has been moved to its use location and the inlet tube 40 connected to the short hose attached to the faucet, the hose 22 can be payed out by merely pulling on it. As the hose guide 28 is relatively freely movable on the horizontal rail 128, the hose may be payed out without interference.

After completion of the watering, the hose 22 is rewound as described above with the operator grasping the knob 142 to move the guide 28. It will be appreciated that the operator may exert a downward force on the hose guide 28 to assist in stabilization of the cart. The downward force exerted will load the bearings 42 of the frame sides 34, 36. However, as the O-rings 122 carried by the horizontal inlet portion 102 are in vertical alignment with the bearing surface 44, they are not loaded. Even when the hose contains water, it still may be easily coiled because the cart has a relatively low center of gravity. After completion of the winding, the operator merely steps to the rear of the cart and places his or her foot against the rear bar 54 while using the handle 68 to tilt the cart on the wheels 52 thereby allowing convenient movement of the cart 20 and hose 22 back to the storage location.

As a method of coiling a garden hose using the portable garden hose cart 20, the present invention includes the following steps:

(a) the reel 24 is rotated by operating the crank 26 with one hand to take up the hose;

(b) the hose guide 28 is moved from adjacent the left position shown in FIG. 1 to the right position shown in FIG. 3 in concert with the cranking to form an interior hose layer with adjacent turns of the layer touching;

(c) the guide 28 is moved from the right position toward the left position in concert with the cranking to form a second layer of closely adjacent turns; and, if the hose is not yet fully taken up, (d) the guide is continued to be moved between its positions while cranking to place outer layers of the garden hose until the hose is fully coiled, all of these steps being performed without the user touching the garden hose.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable garden hose cart for windably holding a garden hose and for use in transporting said garden hose between a storage location and a use location, said cart comprising:

a frame including a pair of generally vertical sides each of which has a bearing with a bearing surface;

a reel for windably receiving said garden hose disposed between said frame sides, said reel having a pair of reel sides and a hose support surface extending between said reel sides, each reel side including a generally horizontally extending hub, each hub being rotatably received in the corresponding bearing surface of its associated frame side;

an outlet tube carried by said reel for rotation therewith and having an end adapted for attachment to one end of said garden hose;

an inlet tube mounted in one of said hubs so that said inlet tube does not rotate with said reel with said inlet tube and said outlet tube being in fluid communication;

means for rotating said reel to take up said hose; and a hose guide defining a window for passage of said hose, said frame further including means for supporting said hose guide spaced from said reel, said hose guide permitting substantially free passage of said hose through said window, and said hose guide being substantially freely movably along a horizontal path whereby said hose can be wound on said reel in layers with adjacent turns in each layer being contiguous and without the operator touching said hose, by the operator simultaneously operating said means for rotation and moving said hose guide, said means for supporting said hose guide comprising an aligned arm extending from each side, with the arms holding between their distal ends a single horizontal rail of non-circular cross section and disposed above said window, said hose guide including a housing comprising a pair of similar molded thermoplastic housing halves threadably fastened together, said halves together defining a channel above and transversely of said window receiving said rail with said channel having a cross section similar to that of said rail so that said hose guide is substantially non-rotatably held by said rail, said housing halves pivotally carrying roller means extending into the top portion of said channel engaging the top surface of said rail.

2. A cart as set forth in claim 1 wherein said roller means comprises a pair of spaced wheels, each wheel having spaced flanges flanking said rail.

3. A cart as set forth in claim 2 wherein each wheel includes a central annular ridge for localizing contact of the wheel with said rail intermediate said flanges.

4. A cart as set forth in claim 1 wherein said housing further includes a knob disposed above other components of said hose guide to be grasped by the user to reciprocate said guide on said rail.

5. A cart as set forth in claim 1 wherein said hose guide further comprises a pair of spaced vertically disposed rollers rotatably held by said housing to form sides of said window for engaging said hose to facilitate its winding.

6. A cart as set forth in claim 5 wherein said housing further comprises scrapper means extending closely adjacent each roller for removing foreign matter transferred to the rollers from the hose.

7. A cart as set forth in claim 6 wherein said scrapper means includes a pair of inwardly directed and converging scrapper blades associated with each roller.

8. A cart as set forth in claim 7 wherein each roller includes a concave working surface for engaging said hose, each of said blades terminating in a convex scrapping edge.

9. A cart as set forth in claim 1 further comprising a storage box disposed intermediate said sides and above said reel, said box including a pivotal lid and floor with drain apertures.

10. An improvement in a portable garden hose cart for windably holding a garden hose and for use in transporting said hose between a storage location and a use location, said apparatus comprising:

a frame including a pair of generally vertical sides each of which has a bearing with a bearing surface;

a real for windably receiving said garden hose disposed between said frame sides, said reel including a pair of reel sides and a hose support surface extending between the reel sides, each reel side including a generally horizontally extending hub, each hub being rotatably received in the corresponding bearing surface of its associated frame side;

conduit means for transporting water to said hose and carried by said reel for rotation therewith and having an end adapted for attachment to an end of the garden hose;

a horizontal inlet tube mounted in one of said hubs so that said inlet tube does not rotate with said reel;

an O-ring in sealing engagement with both said inlet tube and said one of said hubs, said O-ring being retained inside said one of said hubs substantially vertically aligned with the bearing surface of the frame side holding that hub; and a hand crank attached to the other of said hubs for rotating said reel to take up said hose, said improvement comprising:

a hose guide supported by said frame spaced from said reel and disposed above said hubs and substantially freely horizontally movable across said hose support surface, said guide including a window for passage of said hose and handle means for grasping by the user whereby using one hand to crank said reel and the other hand to reciprocate the guide, the user can wind the hose into a layered coil with adjacent turns in each layer being contiguous, without substantial loading of said O-ring, each frame side having an arm extending therefrom, the arms being aligned and their free ends holding a single horizontal rail, of non-circular cross section, which supports said hose guide solely above the level of said window, said hose guide including a housing formed by a pair of molded thermoplastic housing halves fastened together, said housing halves together defining a channel having a cross section similar to that of said rail non-rotatably receiving said rail, each of said housing halves comprising two spaced bearings disposed above the level of said channel with each bearing being aligned with a corresponding bearing of the other half to form a pair of bearings, said hose guide further comprising a pair of spaced wheels each held by one of the pair of bearings with each wheel extending partially into said channel and engaging the top of said rail.

11. A cart as set forth in claim 10 wherein said rail is of rectangular cross section and has a top surface disposed in a horizontal plane.

* * * * *